United States Patent [19]

Rockenfeller et al.

[11] 4,237,354

[45] Dec. 2, 1980

[54] PRESSURE CHANGE RESPONSIVE DEVICE

[75] Inventors: John D. Rockenfeller, Grand Island; Thomas E. Llewellyn, Lockport, both of N.Y.

[73] Assignee: Textron Inc., Providence, R.I.

[21] Appl. No.: 971,861

[22] Filed: Dec. 21, 1978

[51] Int. Cl.[3] ..... H01H 35/32

[52] U.S. Cl. ..... 200/83 C; 200/83 L; 73/729

[58] Field of Search ..... 335/207; 92/34; 73/708, 73/729, 386, 387; 200/83 R, 83 C, 83 D, 83 L, 83 Y, 83 W, 81 R, 82 E, 82 R, 81.9 R, 81.9 M

[56] References Cited

U.S. PATENT DOCUMENTS

| | | | |
|---|---|---|---|
| 2,355,894 | 8/1944 | Ray | 200/83 L |
| 2,411,577 | 11/1946 | Leslie | 200/83 C |
| 3,809,835 | 5/1974 | Watt | 200/83 D |
| 3,852,546 | 12/1974 | Maxwell, Jr. | 200/83 D |
| 3,946,175 | 3/1976 | Sitabkhan | 73/729 |
| 3,982,217 | 9/1976 | Reynolds | 200/83 L |

FOREIGN PATENT DOCUMENTS

| | | | |
|---|---|---|---|
| 2021984 | 11/1970 | Fed. Rep. of Germany | 200/83 L |

*Primary Examiner*—Gerald P. Tolin

*Attorney, Agent, or Firm*—Bean, Kauffman & Bean

[57] ABSTRACT

A pressure switch unit capable of withstanding high pressures without losing its low pressure sensitivity or calibration includes a magnetically actuated switch responsive to the magnetic field of a permanent magnet mounted on a hermetically sealed bellows which contains on its interior a substantially incompressible liquid. The amount of liquid hermetically sealed within the bellows is selected to be sufficient to prevent any portion of the bellows from exceeding its elastic limit when the bellows is compressed by exposure to excessively high pressures.

13 Claims, 3 Drawing Figures

Fig. 2.
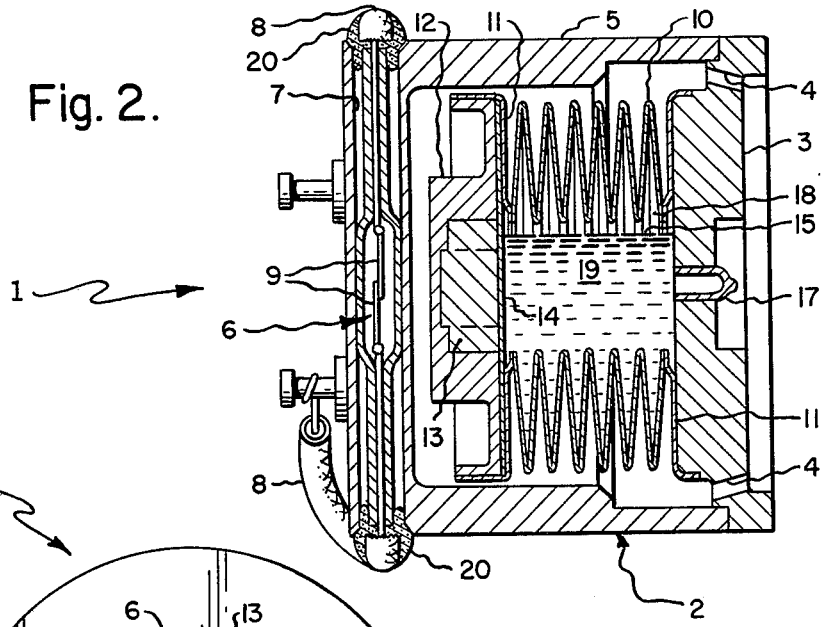
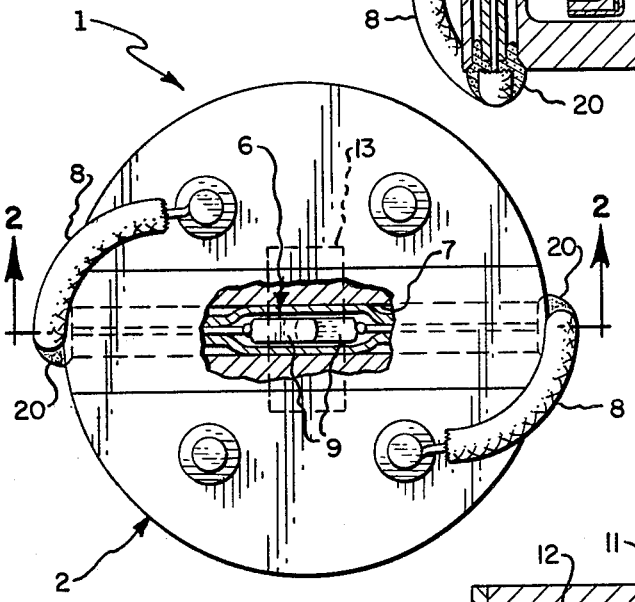
Fig. 1.
Fig. 3.
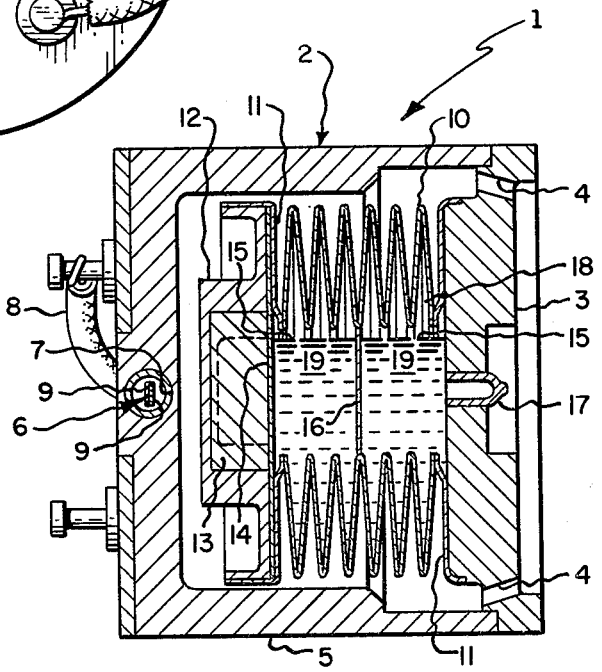

PRESSURE CHANGE RESPONSIVE DEVICE

TECHNICAL FIELD OF THE INVENTION

The apparatus of the present invention relates to the detection of a leak in closed, low pressure systems. It is particularly suited for incorporation in a system which is exposed to high pressures such as those applied during proof pressure testing of welds and other components of the assembled system.

BACKGROUND OF THE INVENTION

Many practical applications exist in which it is desirable to detect pressure conditions within an enclosed environment. To this end it is desirable to use a pressure detector which avoids creating penetrations which are subject to leaks such as result when electrical leads pass into the enclosure. In such applications, a conventional approach adopted to avoid electrical penetrations has been to provide a magnetically actuated switch responsive to a magnet carried by a flexible member whose degree of deflection is determined by the existing pressure conditions. It has long been an objective of those versed in the art to find a means whereby the foregoing functions could be achieved in a simple and economical fashion. That these objectives have not been satisfactorily achieved is evidenced by the multitude of inventions proposed to this end, representative of which are those disclosed in the following patents:

| U.S. PAT. NOS. | ISSUED |
|---|---|
| 2,411,577 | November 26, 1946 |
| 3,327,079 | June 20, 1967 |
| 3,450,853 | June 17, 1969 |
| 3,536,875 | October 27, 1970 |
| 3,654,601 | April 4, 1972 |
| 3,859,619 | January 7, 1975 |
| 3,873,787 | March 25, 1975 |
| 3,924,086 | December 2, 1975 |
| 3,946,175 | March 23, 1976 |
| 4,059,823 | November 22, 1977 |

One particular problem has especially plagued the devices of the prior art in applications in which the assembled system, including the pressure detector, is proof pressure tested in order to meet acceptance specifications. Such proof pressure testing is frequently required to test the integrity and strength of assembly welds in pressure tanks. Application of the proof pressure to the assembled system may subject the pressure detector, which is an integral part of the assembled system, to excessive pressures: a pressure of 2500 psia being typical. Any of the conventional prior art pressure responsive switches, as typified by those disclosed in the above listed patents may be expected to fail completely or at least to lose its sensitivity and/or calibration when subjected to proof pressures as high as this. The high pressure causes the resilient member, upon whose proper operation the detector relies, to exceed its elastic limit so that when the proof pressure is removed the device fails to return to its original setpoint. U.S. Pat. No. 3,982,217 attempts and partially suceeds in addressing this problem by providing a cylindrical stop means mounted inside the bellows of the device. It will be recognized that this artifice does not effectively prevent damage to the bellows under very high pressures, however, since its convolutions are not completely supported by the cylindrical stop means so that failure by way of collapse of those unsupported portions of the bellows necessarily occurs. When the elastic limit is exceeded, permanent distortion or total rupture results.

THE INVENTION

These and other deficiencies of the prior art pressure detectors have been satisfactorily solved in the apparatus of the present invention which includes a pressure responsive device capable of responding to the changes in pressure within a design pressure range, while at the same time being capable of withstanding high pressures relative to said design pressure range without detrimental effect on sensitivity and/or calibration.

The apparatus of the present invention includes a hermetically sealed container having at least one elastically flexible portion which permits the container to contract and expand in proportion to externally applied pressures. Excessive collapse of the hermetically sealed elastically flexible container is prevented by the inclusion on its interior of a substantially incompressible liquid occupying a volume at least large enough to prevent the container from collapsing beyond the point at which the flexible portion of the container exceeds its elastic limit. Means operatively associated with the container for responding to the expanded/contracted condition of the container and therefore responsive to pressure variations are also provided. One possible means includes a permanent magnet mounted on the container and a magnetically responsive switch such as a reed switch mounted adjacent to the container. The magnetic field of the permanent magnet thus influences the condition of the switch in proportion to existing pressure.

Various modifications and/or improvements to this basic apparatus design include an arrangement in which the incompressible liquid occupies a volume less than the interior volume of the container when the detector is exposed to pressures within the design range of detection. In one embodiment, the volume not occupied by the incompressible liquid is substantially evacuated while in another the unoccupied volume may include a gaseous medium which is either the gaseous phase of the incompressible liquid or the gaseous phase of a different liquid. Furthermore, in the latter embodiment, the remaining volume may be preloaded or pressurized. In this case a failure which produces a leak in the container is detected as the internal pressure of the container is reduced to produce contraction of the container and consequent change of state of the magnetically responsive switch.

In one of the preferred embodiments the substantially incompressible liquid is silicone oil whose vapor pressure is less than $10^{-6}$ torr. With such a low vapor pressure the volume on the interior of the container not occupied by the silicone oil is essentially a vacuum. This embodiment has the advantage that the pressure detector is thereby rendered substantially insensitive to temperature variations due to the extremely small vapor pressures of the silicone oil even when the temperature is elevated. Furthermore, in this embodiment the pressure detector is referenced to a vacuum or near vacuum under all practical conditions of operation.

A latchable or "one shot" pressure detector may be obtained by positioning the reed switch such that the magnetic field from the magnet on the bellows in its normal condition is sufficient to keep the leafs of the switch closed but is insufficient to cause the leafs to close of themselves without the influence of an externally applied magnetic field. Accordingly, the detector may be "set" by application of an external field but will not "reset" once a pressure excursion causes the bellows mounted magnet to draw away from the reed switch to a point where the leafs of the switch open.

Another possible embodiment is the arrangement of a plurality of flexible hermetically sealed containers in series so that failure by rupture of one does not render the device inoperative. A series arrangement may be obtained by dividing the internal cavity of a bellows into two chambers by an appropriately positioned partition.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 1 is a plan view of the pressure switch unit of the present invention;

FIG. 2 is a cross-sectional elevation of the pressure switch unit of FIG. 1 taken along view lines 2—2; and FIG. 3 is a cross-sectional elevation of a pressure switch unit similar to that shown in FIGS. 1 and 2 but taken along view lines perpendicular to 2—2 of FIG. 1.

DESCRIPTION OF THE BEST MODE OF THE INVENTION

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalents.

Turning now to an examination of the figures, a variety of embodiments of the invention will be particularly described. In the figures, the pressure switch unit of the invention is generally indicated by numeral 1. The switch includes a housing 2 comprising a cup-shaped housing portion 5 of a magnetically permeable material such as stainless steel or any of the mild carbon steels and a bottom plate 3 having apertures 4 therethrough. Plate 3 is adapted to fit within and close the open end of the housing portion 5 when welded or otherwise sealed in position.

As best seen in FIG. 3, a switch receiving bore 7 is formed within the closed end of housing portion 5 in a manner which avoids electrical penetration. Reed switch assembly 6 having opposite deflectable leafs 9 is preferably mounted and fixed in position by a suitable adhesive or sealant 20 as shown in FIGS. 1 and 2. Electrical leads 8 from opposite ends of the switch are suitably terminated at the electrical binding posts as shown.

A hermetically sealed container having at least one flexible portion is located on the interior of housing 2. As can be seen from FIG. 2, one such container may be constructed from a bellows 10 mounted on an annular end disk 11 which in turn is mounted on bottom plate 3. Bellows 10 is hermetically sealed, such as by welding, to disk 11 and disk 11 is hermetically sealed to end plate 3. At the other end of the bellows, a similar arrangement is found in which the bellows is sealed to a similar annular end plate 11 which in turn is sealed to a bellows end cap 12, thus forming a hermetically sealed internal bellows cavity 19. Variations of the pressure on the interior of housing 2 cause the bellows to contract and expand proportionately.

As can be seen from FIGS. 2 and 3, a permanent magnet 13 is held within a cavity in end cap 12 by a magnet retention disk 14 so that the magnet is mounted on the end of the hermetically sealed bellows system. End cap 12 is also fabricated from a magnetically permeable material to permit the magnetic field to extend outwardly from the bellows past cap 12. Contraction and expansion of the bellows system thus causes magnet 13 to approach and receed from the leafs 9 of reed switch 6 and the magnetic field experienced by reed switch 6 is varied in proportion to the position of permanent magnet 13 and therefore in proportion to the state of contraction or expansion of bellows 10 which has a relation to the pressure on the interior of housing 2.

In order to render the switch of the present invention invulnerable to high pressures, the internal bellows cavity 19 is wholly or partially filled with a substantially incompressible liquid 15 such as silicone oil. Fill tube 17 penetrating through bottom plate 3 is provided for this purpose. In the preferred embodiment as shown in FIG. 2, bellows cavity 19 is only partially filled by liquid 15 so as to leave an unfilled portion 18. The amount of incompressible liquid 15 placed within bellows cavity 19 must be sufficient to prevent any portion of bellows 10 from exceeding its elastic limit when exposed to exceedingly high proof pressures. On such exposure, bellows 10 collapses until the volume of bellows cavity 19 is equal to the volume of the incompressible liquid 15 so that the incompressible liquid 15 supports each and every portion of the bellows 10 against the externally applied pressure. In this manner, the pressure switch of the present invention is rendered insensitive to pressures of virtually any magnitude. Upon removal of the externally applied pressures, bellows 19 will once again expand to its original configuration thereby reliably returning the switch apparatus to its original setpoint since the elastic limit of the material comprising the bellows has not been exceeded.

In the embodiment described above, silicone oil is mentioned as an example of a possible substantially incompressible liquid. Silicone oil is desirable in the event that the pressure switch is intended to reference against a vacuum. In such a circumstance, and where the pressure to be detected is sub-atmospheric, the interior cavity 19 of bellows 10 can be filled with silicone oil at standard temperatures and pressures. The unit is then placed in the sub-atmospheric pressure environment and bellows 10 tends to expand and create a volume 18 within bellows cavity 19 not occupied by the oil but only by its vapor. Since silicone oil has a partial pressure of $10^{-7}$ torr, the interior portion 18 of bellows 10 not occupied by the silicone oil approaches a perfect vacuum. In this circumstance, the pressure detector of the present invention references against vacuum conditions. Accordingly, pressure conditions between complete vacuum and atmospheric pressure influence the degree of expansion or contraction of the bellows. Accordingly, the pressure detector of the invention may be constructed to detect a pressure as low as 50 torr.

For example, in a situation in which the detector is designed to detect a pressure of 300 torr, the axial dimension of bellows 10 and the location of reed switch 6 can be established such that at pressure conditions less than 300 torr magnet 13 is positioned close enough to reed switch 6 to cause leafs 9 of switch 6 to be closed. A low resistance condition of reed switch 6 results and is indicative of a pressure condition less than 300 torr. When the pressure on the interior of housing 2 increases to a value of 300 torr, the bellows contracts to cause magnet 13 to be pulled away from reed switch 6 to a position at which its magnetic field no longer is capable of maintaining a closed condition in the switch. Switch 6 therefore opens to produce a condition of high resistance indicative of a pressure of 300 torr or more. The low or high resistance condition of switch 6 can be detected externally by an ohmmeter type device so that it is clear that the pressure detector itself is a completely passive device requiring no expensive and space occupying dedicated power supply. This is advantageous in applications where available space is at a minimum.

It is possible within the scope of the present invention to reference against a pressure other than vacuum. If such a circumstance were desired, the substantially incompressible fluid 15 which is inserted into the interior of bellows 10 could be selected so as to have a partial pressure not nearly as small as that of silicone oil. One example might be alcohol so that the pressure detector references against the boiling point of the alcohol rather than a vacuum condition. In this arrangement, as the pressure on the interior or housing 2 is reduced below atmospheric pressure, and as the bellows 10 expands, the alcohol liquid evaporates to fill expanding volume 18 with its gaseous phase. Another variation of many possibilities includes a mixture of liquid and gaseous components within bellows 10. Thus silicone oil may be used in combination with alcohol so that when the device is placed in sub-atmospheric conditions the alcohol evaporates completely to fill gap 18. In this latter example, in order to prevent failure of the device when exposed to high pressures in accordance with the present invention, the volumes of the liquid phases of both components must be sufficient to prevent bellows 10 from exceeding its elastic limit when compressed.

While the above described embodiments and variations thereof have been described in terms of drawing evacuated conditions or partially evacuated conditions on the interior of bellows 10 and when the device is placed in subatmospheric conditions, it is possible to preload or pressurize the interior of bellows 10 with a pressurized fluid. This expedient may be utilized to produce a fail safe detector. With this variation, as one will recognize, if bellows 10 fails by developing a leak, any pressurized fluid on its interior tends to escape thereby reducing the interior pressure and contracting the bellows. Contraction of the bellows withdraws magnet 13 from reed switch 6 to change its condition and indicate a failure.

An additional embodiment is shown in FIG. 3 in which the internal cavity 19 of bellows 10 has been divided in half by a partition 16. This expedient basically places two bellows sections in series with one another to provide redundancy and increased reliability. In this embodiment, a failure in one portion of the bellows would not necessarily cause failure of the entire detector.

A latchable or "one-shot" detector may be obtained by arranging the components of the detector such that magnet 13 cannot get close enough to reed switch 6 or is too weak to cause the leafs 9 of the switch to close but is close enough to cause the leafs 9 of switch 6 to remain closed once closure has been obtained by the influence of an externally applied magnetic field. With such an arrangement, an increased pressure causes magnet 13 to recede from the reed switch thereby permitting the switch to open and remain open regardless of whether the pressure returns to its previous value. Such "one-shot" or latching detector forces an intentional resetting of the detector so that a transitory pressure variation does not go unnoticed.

While the pressure detector of the present invention has been described in the context of detecting an increase in sub-atmospheric pressures, it should be evident that other uses are equally possible. Thus the detector may be arranged to detect decreases in sub-atmospheric pressures or increases or decreases in super-atmospheric pressures. The one requirement common to all applications, however, is that the interior volume of the bellows occupied by the incompressible liquid must be large enough to prevent collapse of the bellows beyond its elastic limit when exposed to pressures that are high relative to the designed pressure range in which the detector is designed to be operative. Furthermore, the invention has been described in terms of a pressure detector utilizing a magnetically responsive switch as a transponder. It should be clear, however, that the invention is not nor is it intended to be so limited. Thus, alternative types of transponders or actuators may be interfaced with the bellows and may perform functions different from the function of pressure detection.

What is claimed is:

1. A pressure responsive apparatus capable of withstanding high pressures relative to the normal pressure range within which said apparatus is operative without experiencing losses in operability, sensitivity or calibration, said apparatus including:

(a) a hermetically sealed container having at least one elastically flexible portion which permits said container to contract and expand in proportion to externally applied pressure within said normal pressure range, correspondingly to define a minimum volume corresponding to the highest pressure in said range and a maximum volume corresponding to the lowest pressure in said range;

(b) a substantially incompressible liquid in the interior of said sealed container, said liquid occupying a volume which is less than said minimum volume whereby to permit said container to be subjected to a test pressure greater than said highest pressure while preventing said container from collapsing beyond the point at which said flexible portion of said container exceeds its elastic limit; and (c) means operatively associated with said container for responding to the expanded/contracted condition of said container within said normal pressure range.

2. The pressure responsive apparatus as recited in claim 1 wherein said substantially incompressible liquid has a vapor pressure less than $10^{-6}$ torr.

3. The pressure responsive apparatus as recited in claim 2 wherein said substantially incompressible liquid is silicone oil.

4. The pressure responsive apparatus as recited in claim 1 wherein the interior volume of said container not occupied by said substantially incompressible liquid contains a vacuum.

5. The pressure responsive apparatus as recited in claim 1 wherein the interior volume of said container not occupied by said substantially incompressible liquid is occupied by a pressurized gas within said normal pressure range.

6. The pressure responsive apparatus as recited in claim 1 wherein the interior volume of said container not occupied by said substantially incompressible liquid is filled with the gaseous phase of said liquid.

7. The pressure responsive apparatus as recited in claim 1 wherein said elastically flexible portion of said container is a bellows.

8. The pressure responsive apparatus as recited in claim 1 wherein said elastically flexible portion of said container is a flexible diaphragm.

9. The pressure responsive apparatus as recited in claim 1 wherein said means operatively associated with said container includes a magnet fixed to said container and a magnetically actuated switch fixed adjacent to said container in proximity to said magnet.

10. The pressure responsive apparatus as recited in claim 7 wherein said bellows includes an interior partition axially dividing said bellows into first and second hermetically sealed chambers, each chamber including therein a substantially incompressible liquid.

11. The pressure responsive apparatus as recited in claim 9 wherein said magnetically actuated switch is a reed switch having magnetically permeable leafs, said reed switch being fixed in a position relative to said magnet fixed to said container such that the magnetic field from said magnet at the position of said reed switch is too weak to cause the switch to close but is such that, after said reed switch has been closed by the influence of an externally applied magnetic field, the magnetic field of said magnet is of sufficient strength to keep said reed switch in its closed condition until said magnet is caused to move away therefrom by contraction of said container under the influence of pressure, whereby said pressure responsive apparatus is a latchable, one-shot, device.

12. In a sealed housing assembly adapted to be subjected to an internal pressure within a specified pressure range during normal operation but which must withstand a test pressure very much higher than the highest pressure in said range;

a pressure sensor unit sealed within said housing and a pressure detecting unit disposed externally of said housing and cooperating with said sensor unit to respond to a predetermined pressure within the housing without requiring any penetration of the housing;

said sensor unit comprising a sealed collapsible/expansible member which defines a minimum volume at the highest end of said pressure range and a maximum volume at the lowest end of said pressure range; and a volume of incompressible liquid contained within said collapsible/expansible member, said volume of liquid being less than said minimum volume but greater than that volume which would permit permanent deformation of said collapsible/expansible member during testing of said housing at said test pressure.

13. In an assembly as defined in claim 12 wherein said sensor unit includes a permanent magnet and said pressure detecting unit includes a magnetic reed switch.

* * * * *